US010181243B1

(12) United States Patent
Piccoli

(10) Patent No.: US 10,181,243 B1
(45) Date of Patent: Jan. 15, 2019

(54) ADJUSTABLE BELT SECURITY DEVICE

(71) Applicant: Checkpoint Systems, Inc., Thorofare, NJ (US)

(72) Inventor: Anthony F. Piccoli, West Deptford, NJ (US)

( * ) Notice: Subject to any disclaimer, the term of this patent is extended or adjusted under 35 U.S.C. 154(b) by 0 days.

(21) Appl. No.: 15/838,144

(22) Filed: Dec. 11, 2017

(51) Int. Cl.
*G08B 13/24* (2006.01)

(52) U.S. Cl.
CPC ..... *G08B 13/2434* (2013.01)

(58) Field of Classification Search
CPC ..... G08B 13/2434; G08B 13/242; G06K 19/07745; E05B 73/0017
See application file for complete search history.

(56) References Cited

U.S. PATENT DOCUMENTS

2009/0135014 A1* 5/2009 Bleckmann ..... G08B 13/2434 340/572.8
2010/0141455 A1* 6/2010 Stefanelli ..... E05B 73/0005 340/572.8
2010/0225485 A1* 9/2010 Appalucci ..... E05B 73/0017 340/572.9
2011/0018716 A1* 1/2011 Piccoli ..... E05B 73/0017 340/572.9
2012/0019385 A1* 1/2012 Brodzik ..... G08B 13/2434 340/572.9

* cited by examiner

*Primary Examiner* — Phung Nguyen
(74) *Attorney, Agent, or Firm* — McDonald Hopkins LLC

(57) ABSTRACT

An example security device is provided that includes a belt attached to a housing. The belt may be insertable into a receiving channel of the housing at an adjustment end of the belt. A lever may be pivotably coupled to the housing. The lever may be configured to pivot relative to the housing between a locked lever position and an unlocked lever position. A hub may be disposed within the housing and coupled to the lever such that the hub rotates as the lever pivots.

20 Claims, 11 Drawing Sheets

ADJUSTABLE BELT SECURITY DEVICE

TECHNICAL FIELD

Example embodiments generally relate to security technology, and more particularly, relate to a security device for use in retail loss prevention.

BACKGROUND

Product security devices are commonly used in a number of settings, including in retail loss prevention. In this regard, retail theft prevention systems, often referred to as electronic article surveillance (EAS) systems, use antennas located at the exits of a retail establishment to detect RF signals emitted by a security device that is affixed to items for sale. A product security device may be affixed or locked to a product, and if the device is not removed at a point-of-sale during a sales transaction, the security device will be detected by the EAS system as the device, which is affixed to an item, leaves the store. An alarm may be triggered because the removal of the device from the retail establishment is likely to be associated with an attempted theft.

SUMMARY OF SOME EXAMPLES

According to some example embodiments, a security device is provided. The security device may comprise a housing having a belt receiving channel and a belt attached to the housing at a secured end of the belt. The belt may be insertable into the receiving channel at an adjustment end of the belt. The belt may also be configured to be wrapped around an article. The security device may further comprise a lever pivotably coupled to the housing. The lever may be configured to pivot relative to the housing between a locked lever position and an unlocked lever position. The security device may further comprise a hub disposed within the housing and coupled to the lever such that the hub rotates as the lever pivots. The hub may include a belt engaging surface and a belt non-engaging surface. The belt engaging surface of the hub may be configured to extend into the belt receiving channel and operably couple with the belt in response to the lever being pivoted into the locked lever position and the adjustment end of the belt being inserted into the receiving channel. The belt non-engaging surface of the hub may be presented to the receiving channel such that the hub does not operably couple to the belt in response to the lever being in the unlocked lever position.

Another example embodiment is a system comprising a security device and a magnetic key. The security device may comprise a locking assembly, a housing having a belt receiving channel, and a belt attached to the housing at a secured end of the belt. The belt may be insertable into the receiving channel at an adjustment end of the belt. The belt may also be configured to be wrapped around an article. The security device may further comprise a lever pivotably coupled to the housing. The lever may be configured to pivot relative to the housing between a locked lever position and an unlocked lever position. The security device may further comprise a hub disposed within the housing and coupled to the lever such that the hub rotates as the lever pivots. The hub may include a belt engaging surface and a belt non-engaging surface. The belt engaging surface of the hub may be configured to extend into the belt receiving channel and operably couple with the belt in response to the lever being pivoted into the locked lever position and the adjustment end of the belt being inserted into the receiving channel. The belt non-engaging surface of the hub may be presented to the receiving channel such that the hub does not operably couple to the belt in response to the lever being in the unlocked lever position. The locking assembly of the security device may be configured to lock the lever to the housing thereby preventing pivoting of the lever in response to the lever being in the locked lever position. The locking assembly may be further configured to unlock the lever from the housing to permit pivoting of the lever in response to application of the magnetic key to the locking assembly.

Another example embodiment is a security device. The security device may comprise a housing having a belt receiving channel and a belt attached to the housing at a secured end of the belt. The belt may be insertable into the receiving channel at an adjustment end of the belt. The belt may be configured to be wrapped around an article. The security device 100 may further comprise a hub disposed within the housing. The hub may be rotatable between a locked hub position and a unlocked hub position. Further, the hub may include a belt engaging surface and a belt non-engaging surface. The belt engaging surface of the hub may be configured to extend into the belt receiving channel and operably couple with the belt in response to the hub being in the locked hub position and the adjustment end of the belt being inserted into the receiving channel. The belt non-engaging surface of the hub may be presented to the receiving channel such that the hub does not operably couple to the belt in response to the hub being in the unlocked hub position.

BRIEF DESCRIPTION OF THE DRAWINGS

Figure 1:
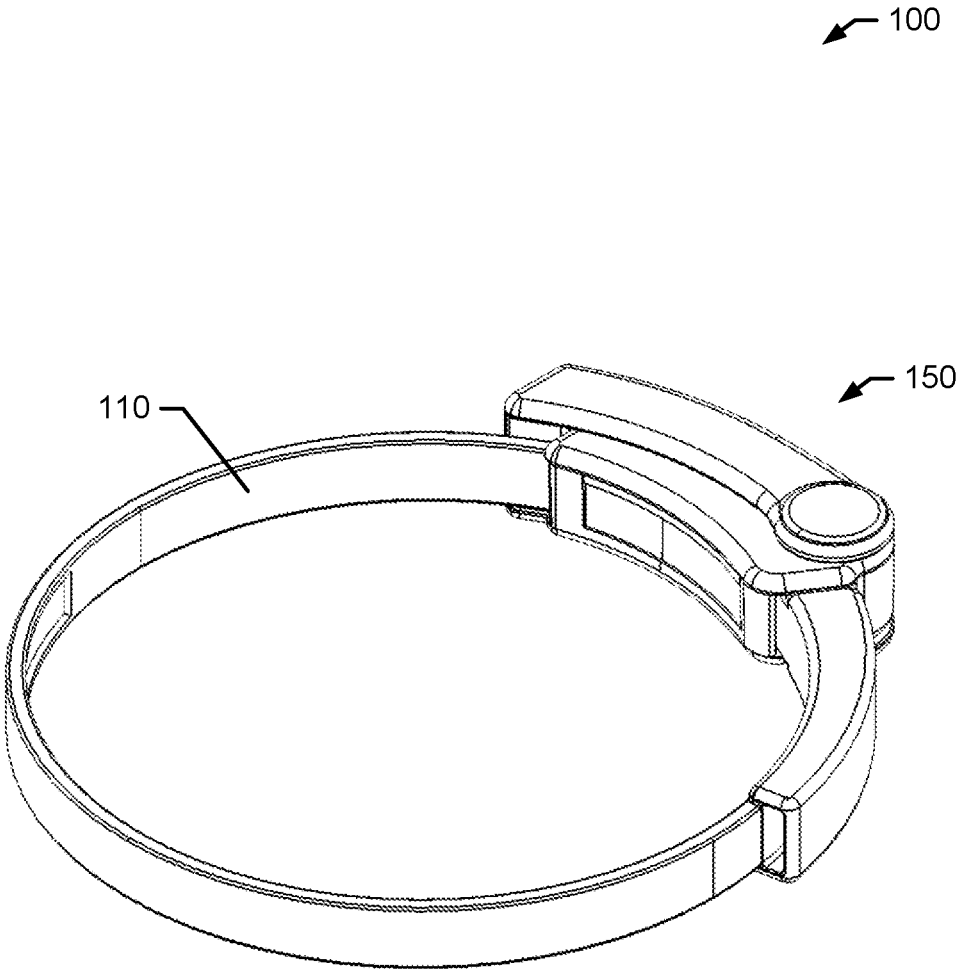
Figure 2:
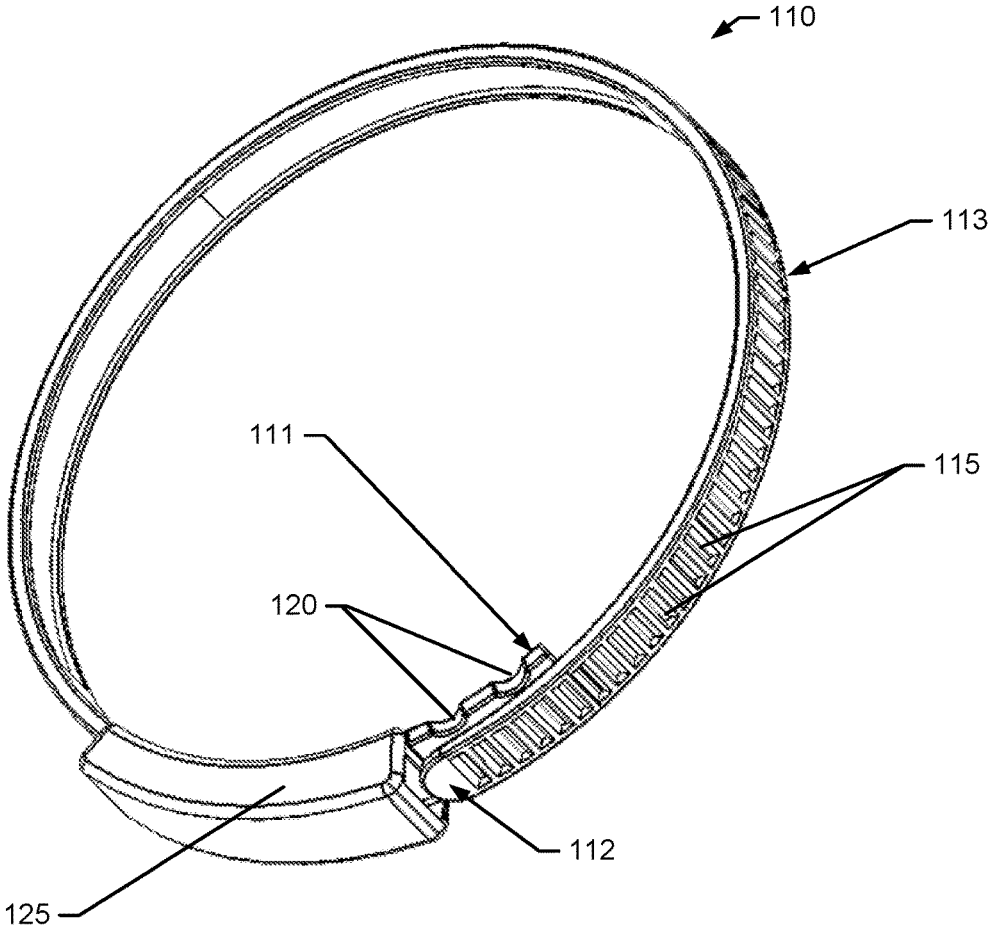
Figure 3:
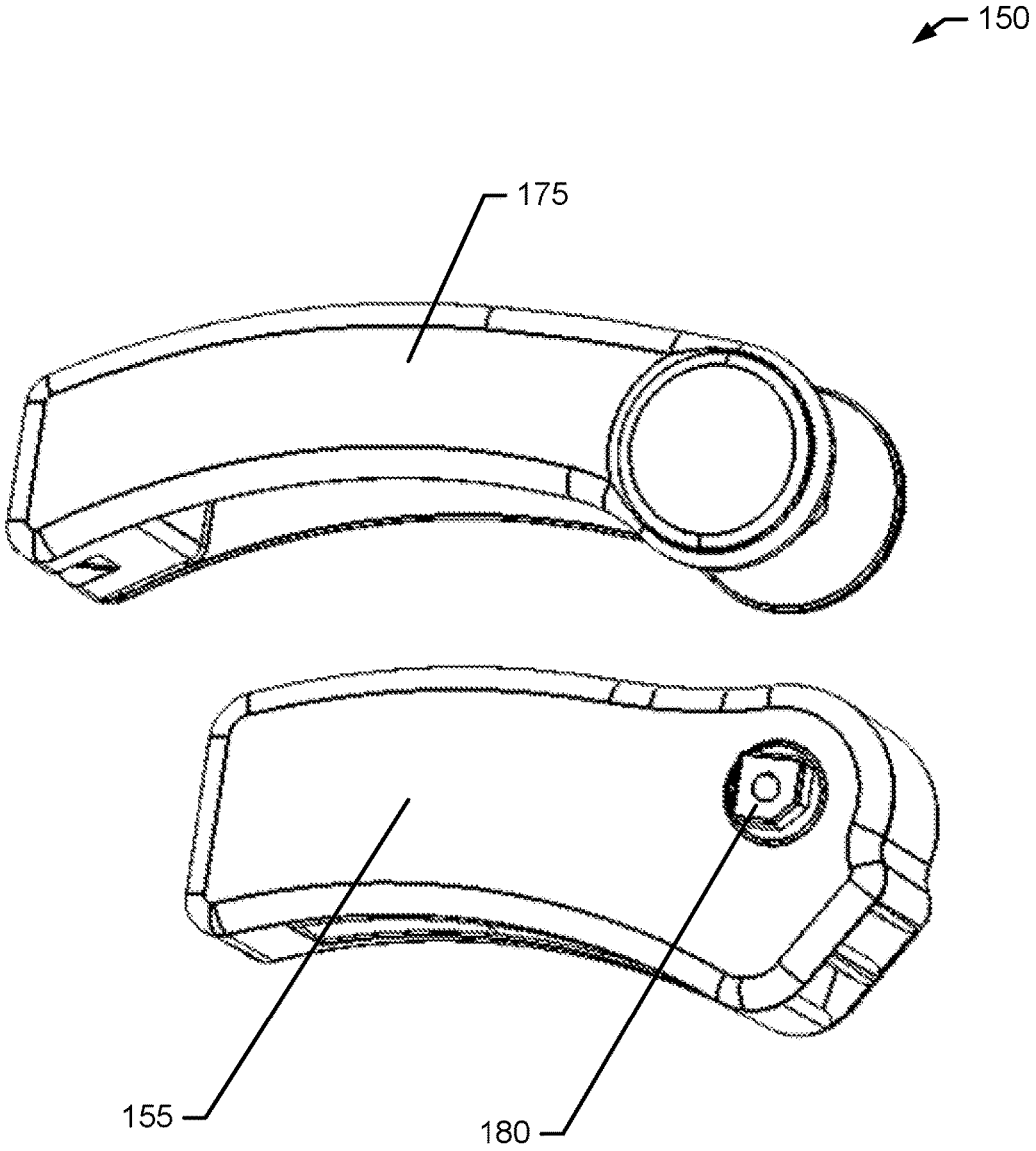
Figure 4:
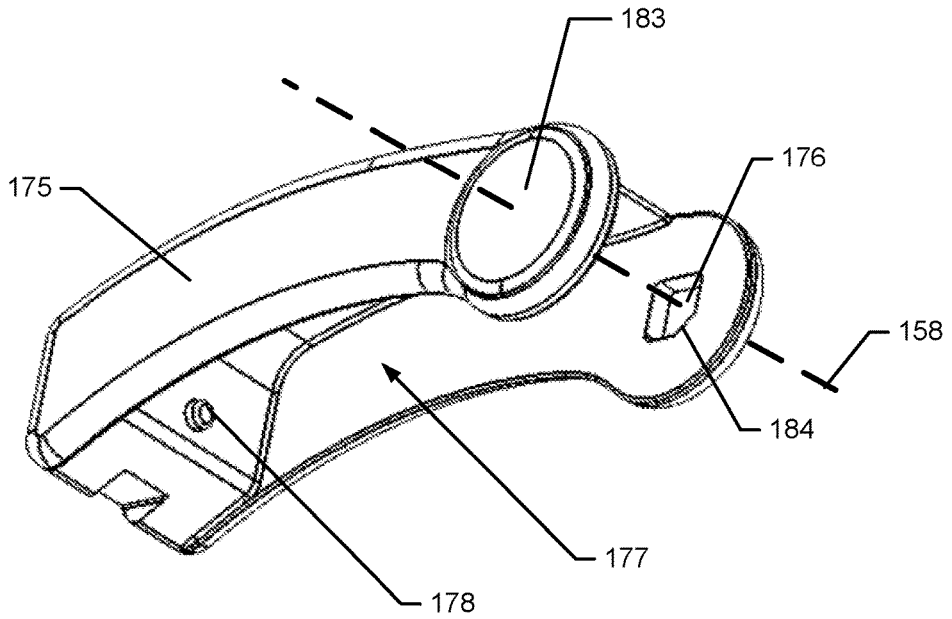
Figure 5:
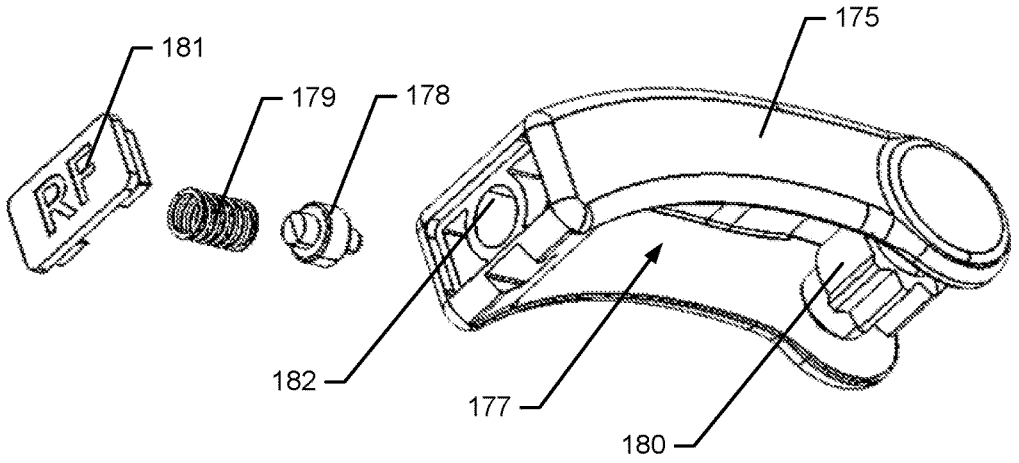
Figure 6:
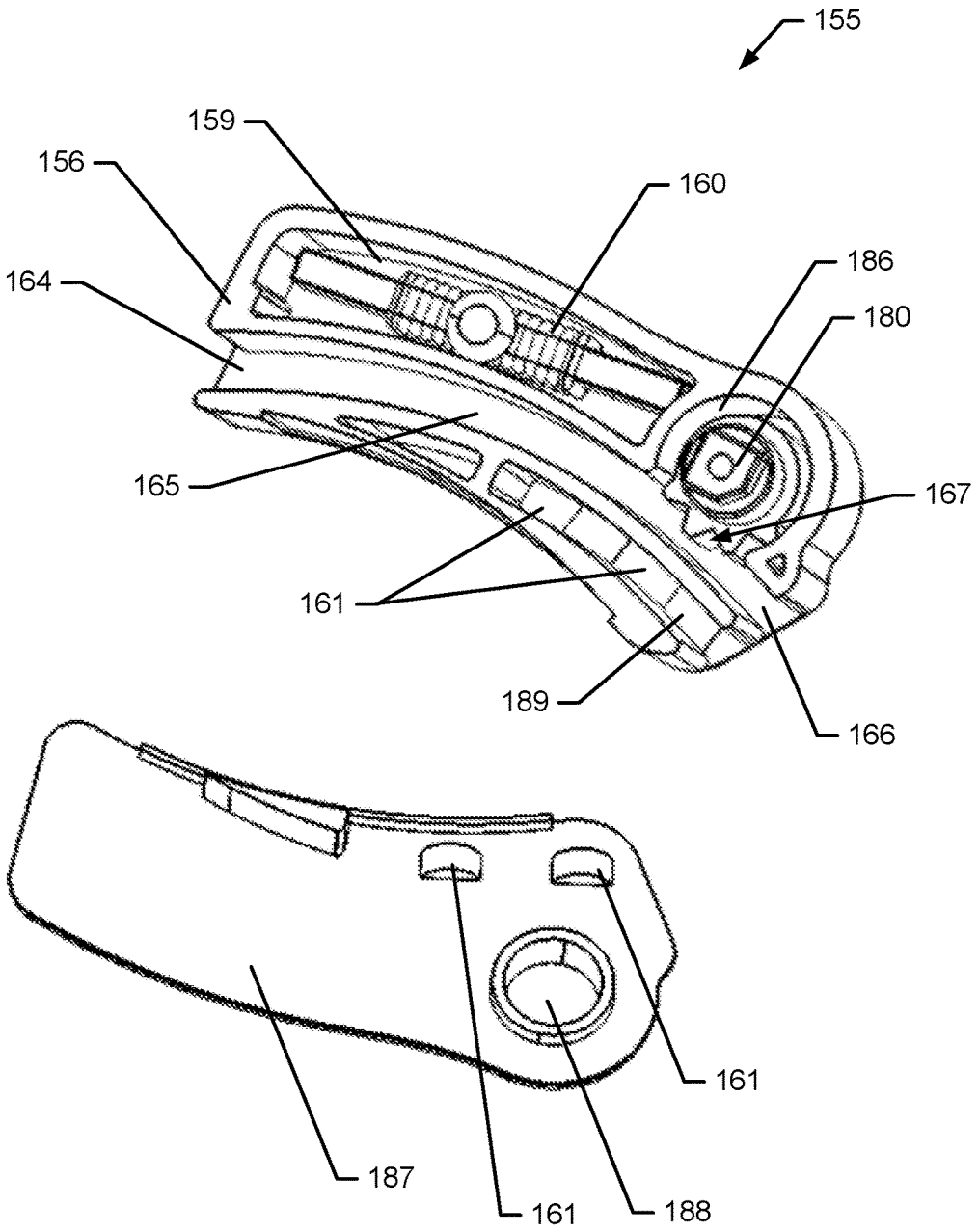
Figure 7:
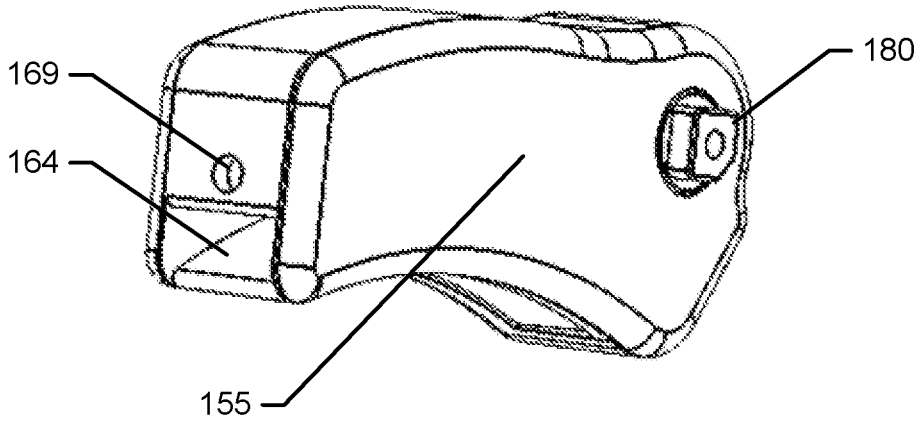
Figure 8:
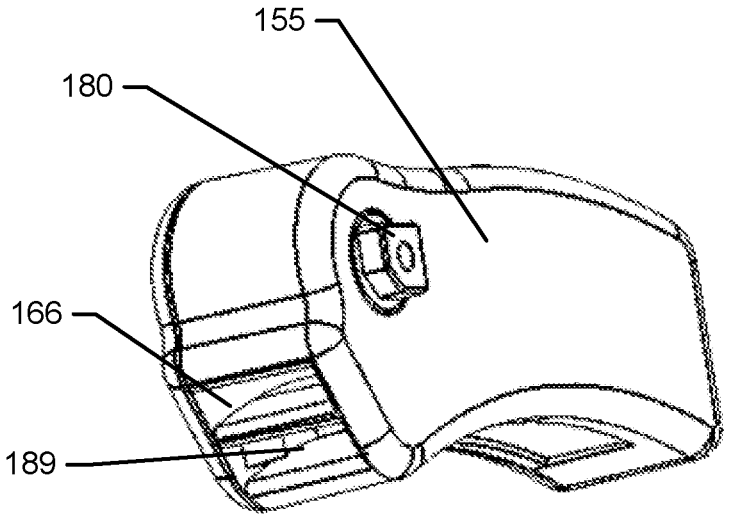
Figure 9:
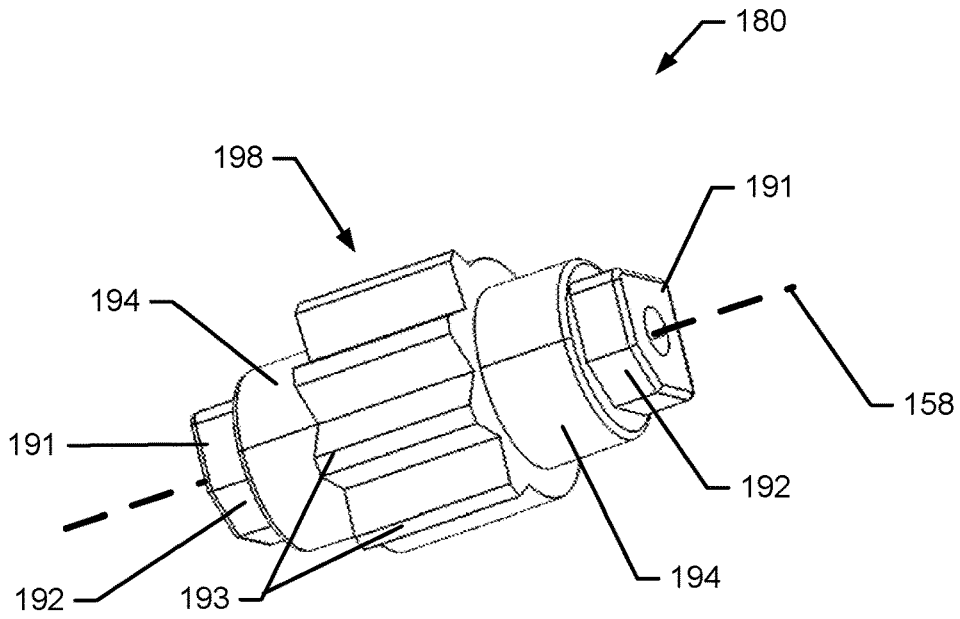
Figure 10:
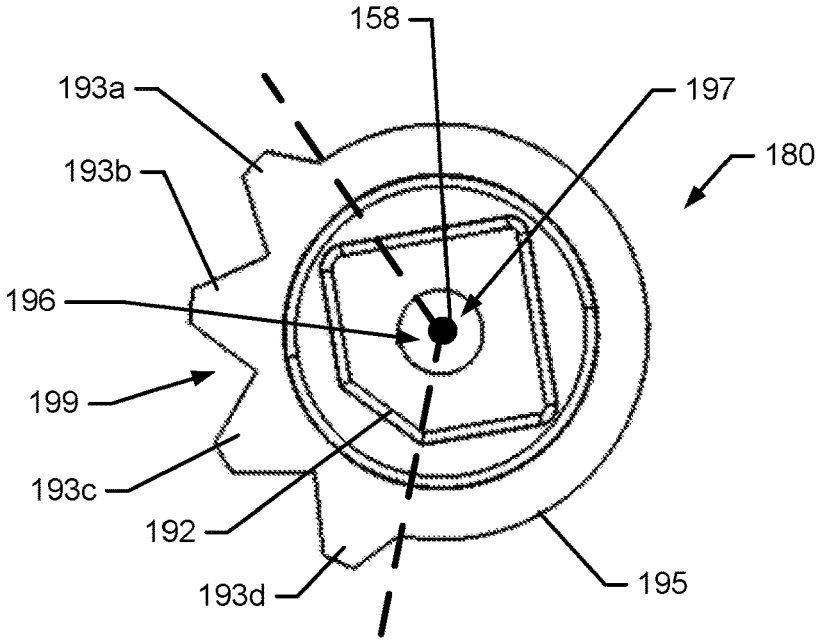
Figure 11:
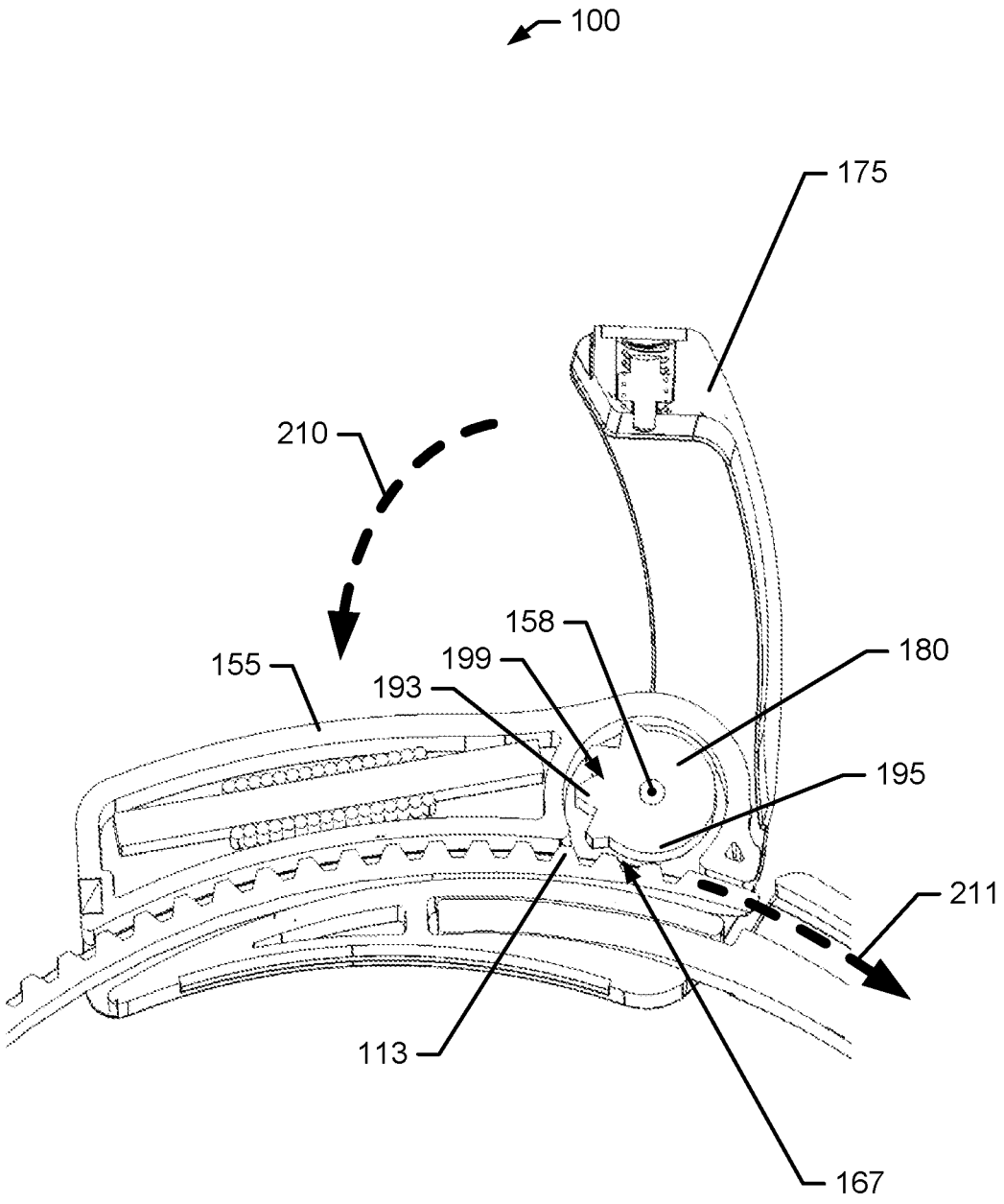
Figure 12:
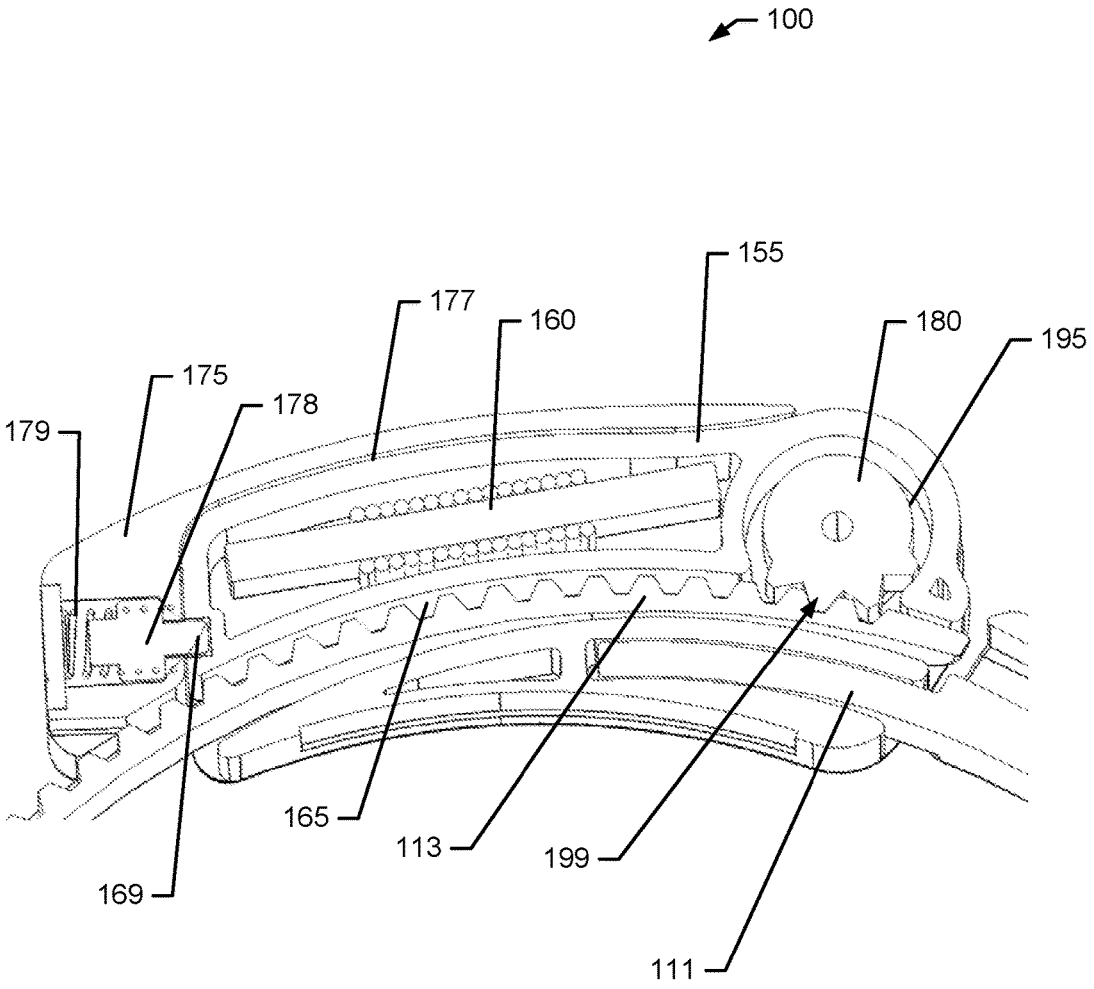
Figure 13:
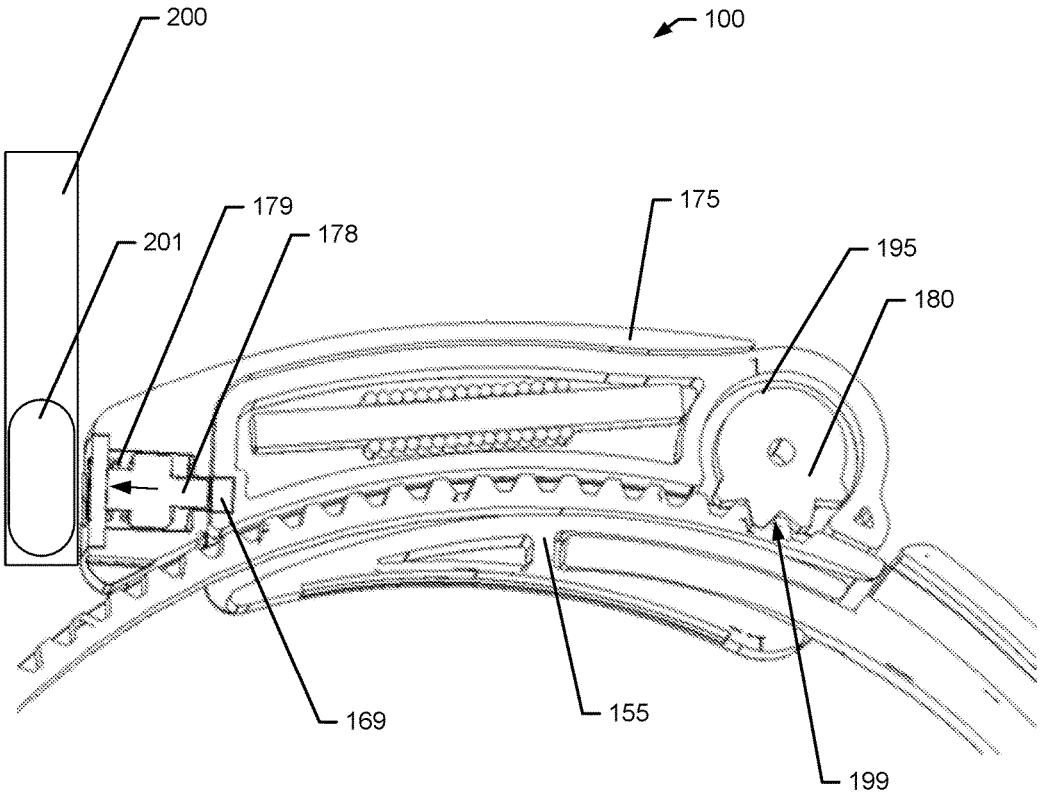
Figure 14:
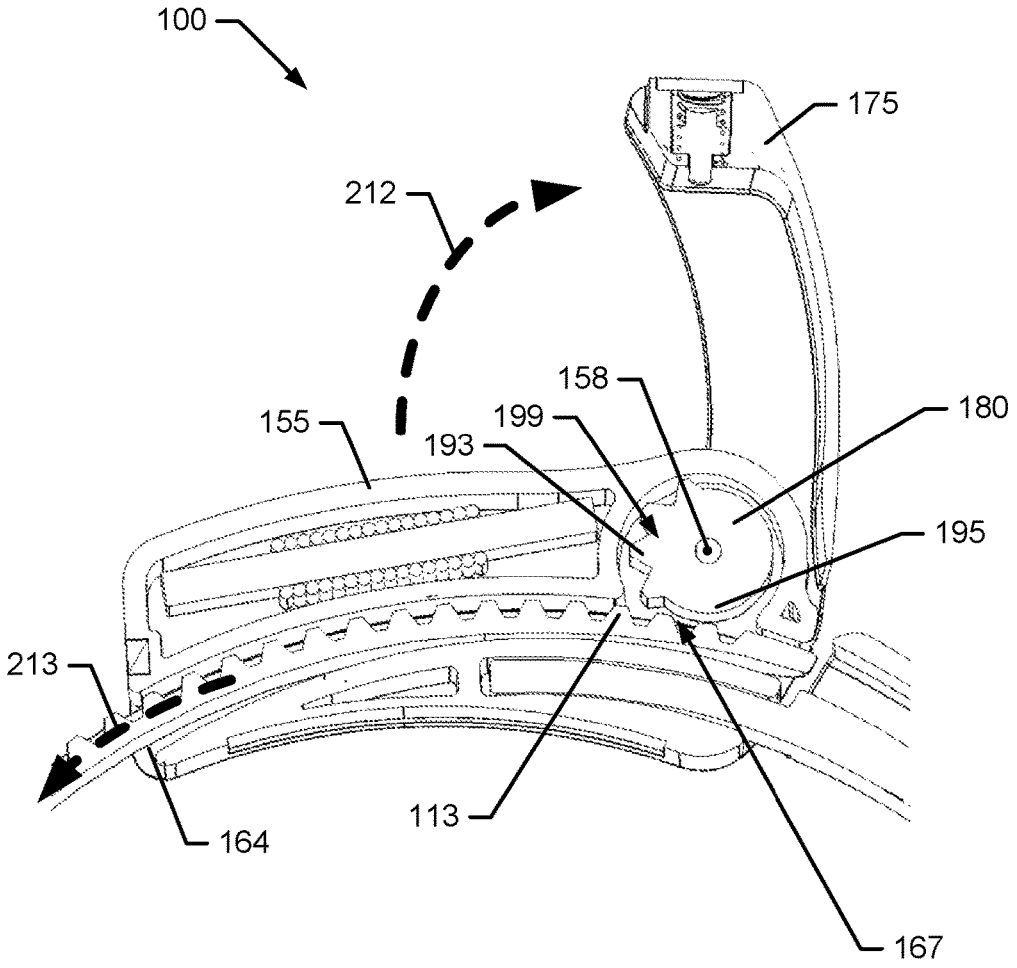

Having thus described the some example embodiments in general terms, reference will now be made to the accompanying drawings, which are not necessarily drawn to scale, and wherein:

FIG. 1 shows a perspective view of an assembled security device in accordance with an example embodiment;

FIG. 2 shows a perspective view of a belt in accordance with an example embodiment;

FIG. 3 shows a disassembled body of the security device comprising a lever, a housing, and a hub in accordance with an example embodiment;

FIG. 4 shows a lever of a security device in accordance with an example embodiment;

FIG. 5 shows a lever of a security device with a portion of a locking assembly in an exploded view in accordance with an example embodiment;

FIG. 6 shows a disassembled view of a housing of a security device in accordance with an example embodiment;

FIGS. 7 and 8 show an assembled view of a housing in accordance with an example embodiment;

FIGS. 9 and 10 show isolated views of the hub in accordance with an example embodiment;

FIG. 11 shows a security device in an unlocked configuration in accordance with an example embodiment;

FIG. 12 shows a security device in a locked configuration in accordance with an example embodiment;

FIG. 13 shows a security device with a key applied in accordance with an example embodiment; and FIG. 14 shows a security device reverting back to an unlocked configuration in accordance with an example embodiment.

DETAILED DESCRIPTION OF SOME EXAMPLE EMBODIMENTS

Some example embodiments now will be described more fully hereinafter with reference to the accompanying drawings, in which some, but not all example embodiments are shown. Indeed, the examples described and pictured herein should not be construed as being limiting as to the scope, applicability or configuration of the present disclosure. Rather, these example embodiments are provided so that this disclosure will satisfy applicable legal requirements. Like reference numerals refer to like elements throughout. As used herein, operable coupling should be understood to relate to direct or indirect connection that, in either case, enables functional interconnection of components that are operably coupled to each other.

According to various example embodiments, an example adjustable security device is provided. The security device may include a belt and a body. The belt may be wrapped around an article and locked to removably attach the security device to the article. The article may be, for example, a retail product to be protected from theft prior to purchase in a retail store. In this regard, the belt may be flexible and adjustable to permit the belt to be wrapped around a variety of articles having differing shapes (e.g., sporting equipment, electronics, candles, or the like, or packaging for the same). The belt may be locked into the body of the security device to secure the security device to the article. Further, the security device may include a security element, for example, in the form of an electronic article surveillance (EAS) tag that operates to provide a wireless signal to, for example, a security gate located at an ingress or egress of a retail store to cause the security gate to alarm, in response to the signal from the tag, to alert store personnel of a possible theft.

FIG. 1 provides a perspective view of an example security device 100 in accordance with some example embodiments. The security device 100 may be comprised of a belt 110 and a body 150. Referring to FIG. 2, the belt 110 may be formed of, for example, plastic or metal, and the belt 110 may take the form of a flat strip of material. According to some example embodiments, the belt 110 may be transparent or portions of the belt 110 may be transparent. According to some example embodiments, the belt 110 may be manufactured in a manner that incorporates a resting curvature to the structure such that the belt 110 takes a generally circular shape when at rest, as seen in FIG. 2, and not under stress or strain.

The belt 110 may include a secured end 111 and an adjustment end 112. The secured end 111 may include features that facilitate permanent attachment of the secured end 111 to the body 150. In this regard, the secured end 111 may include cutouts 120 (e.g., semi-circular shaped cutouts) that engage with complementary nubs 161 (FIG. 6) in the body 150 to permanently secure the secured end 111 of the belt 110 to the body 150.

The adjustment end 112 of the belt 110 may include a tapered, pointed, or rounded tip to facilitate inserting the adjustment end 112 of the belt 110 into a receiving channel 165 (FIG. 6) of the body 150. As further described herein, the adjustment end 112 of the belt 110 may be locked to the body 150 to secure the security device 100 to an article. In this regard, according to some example embodiments, the adjustment end 112 of the belt 110 may include a belt engaging surface 113 that includes one or more engaging features. According to some example embodiments, the belt engaging surface 113 may include one or more grooves 115 (e.g., separated by raised portions or teeth) that are configured to engage with features of the body 150 to facilitate both tightening and locking of the adjustment end 112 of the belt 110 into the body 150. According to some example embodiments, the belt 110 may also include a receiving sleeve 125 that may be affixed to the belt 110 at a position adjacent the secured end 111 of the belt 110. In this regard, the receiving sleeve 125 may be configured to cover and inhibit access to the adjustment end 112 of the belt 110 when the belt 110 is received into and passes through the body 150 as further described below.

With reference to FIG. 3, a partially disassembled view of the body 150 is shown. In this regard, according to some example embodiments, the body 150 may be comprised of a housing 155, a lever 175, and a hub 180. As further described with respect to FIGS. 6-8, the housing may hold or house various components of the body 150 including, for example, the hub 180 and a security element 160. As further described herein, the lever 175 may be pivotably coupled to the housing 155 via the hub 180, which may be maintained within a hub cavity 186 within the housing 155.

The lever 175 is shown in more detail in FIGS. 4 and 5. In this regard, the lever 175 may be elongated and may extend away from a hub engagement end 183 of the lever 175 and a pivoting axis 158. The lever 175 may also include a lever cavity 177 (e.g., a three-sided cavity) that may receive at least a portion of the housing 155 when the lever 175 is pivoted about the axis 158 into a locked lever position. At the hub engagement end 183 of the lever 175, the hub 180 may interface with the lever 175. The lever 175 may include, for example, one or two cavities 176 on internal sides of the lever 175 that receive ends of the hub 180, i.e., lever engaging portions 191 (FIG. 9). In this regard, the cavities 176 may be keyed via a key surface 184 to ensure that the orientation of the hub 180 to the lever 175 is proper during assembly of the security device 100. In this regard, the cavities 176 may be, for example, square in shape with the exception of one corner of the square being keyed so that the hub 180 may only be coupled to the lever 175 in the desired orientation.

Further, the lever 175 may include a portion of a locking assembly. The locking assembly may be configured to lock the lever 175 to the housing 155 thereby preventing pivoting of the lever 175 when the lever 175 is in the locked lever position and a key has not been applied to the security device 100. Further, the locking assembly may be configured to unlock the lever 175 from the housing 155 to permit pivoting of the lever 175 in response to application of a key to the locking assembly. Additionally, the locking assembly may be configured to lock the hub 180 into a locked hub position in response to lever 175 being in the locked lever position, because the lever 175 and the hub move together.

According to some example embodiments, the locking assembly may be comprised of complementary components that are coupled to the lever 175 and the housing 155, which operate to lock the lever 175 to and unlock the lever 175 from the housing 155. According to some example embodiments, the locking assembly may include a slug 178 and spring 179 that urges a tip of the slug 178 towards a locking cavity 169 in the housing 155 to engage the locking cavity 169 and lock the lever 175 in a locked lever position through engagement with the housing 155. As shown, according to some example embodiments, the slug 178 and the spring 179 may be disposed in a slug cavity 182 in the lever 175. In this regard, the slug 178 and the spring 179 may be disposed in the slug cavity 182 and secured into the slug cavity 182 by a cover 181 that may be welded or snapped into place over the slug cavity 182 and the contents.

FIGS. 6, 7, and 8 provide additional views of the housing 155. According to some example embodiments, housing 155 may have a plurality of internal cavities. Such cavities may be formed by two side components that may be welded or otherwise affixed together. In the example embodiments shown in FIG. 6, the two side components are formed of a shell 156 and a cover plate 187.

The shell 156 may include a security element cavity 159 for housing a security element 160. The security element 160 may be, according to some example embodiments, a tag, such as an electronic article surveillance (EAS) tag. In this regard, the security element 160 may incorporate wireless communications technology to transmit wireless signals for loss prevention and inventory tracking purposes. The security element 160 may be a radio frequency resonator, an acousto-magnetic resonator, or an RFID tag and may operate at a radio frequencies such as 8.2 MHz, 58 kHz, or 900 Mhz. In this regard, as a radio frequency resonator or acousto-magnetic device, the security element 160 may resonate in the presence of a electromagnetic field of a certain frequency and return a resonance signal that may be detected. In response to detecting the return resonance signal from the security element 160, a remote alarm may be triggered to indicate that, for example, an individual is attempting to exit a retail establishment without having first had the security device 100 removed from an article, which may be indicative of an attempted theft of the item.

Additionally or alternatively, the security element 160 may comprise an RFID tag. In this regard, the RFID tag may be configured to respond to an interrogation signal with, for example, a unique code stored in a memory of the RFID tag, where the code identifies the RFID tag. As such, the RFID tag may facilitate not only theft deterrence functions, but also inventory counting or tracking of the location of the security device 100 within an environment that is appropriately equipped with tracking hardware. According to some example embodiments, the security element 160 may include both an EAS tag and an RFID tag.

The housing 155 may also include a belt securing cavity 189. As mentioned above, the nubs 161, or protrusions configured to engage the secured end 111 of the belt 110, may be disposed within the belt securing cavity 189. As seen in FIG. 6, according to some example embodiments, four nubs may be disposed in the housing 155 with two nubs 161 disposed on the shell 156 and two nubs 161 disposed on the cover plate 187. During assembly, the secured end 111 of the belt 110 may be placed in the belt securing cavity 189 such that the cutouts 120 align with the nubs 161. The cover plate 187 may then be permanently applied to the shell 156 such that the nubs 161 on the cover plate 187 also align with additional cutouts 120. Accordingly, due to the engagement between the cutouts 120 and the nubs 161 in the belt securing cavity 189, the secured end 111 of the belt 110 may be permanently secured or attached to the housing 155.

Additionally, the housing 155 includes a receiving channel 165 for receiving the belt 110 when the belt 110 is inserted into the housing 155. The receiving channel 165 may have a width and height that is the same or greater than the width and height of the belt 110 to facilitate sliding movement of the belt 110 through the receiving channel 165. Further, according to some example embodiments, the receiving channel 165 may be curved and, for example, have a radius of curvature that may be the same as the radius of curvature of the belt 110, when the belt 110 is at rest. According to some example embodiments, the receiving channel 165 may have a belt entry opening 164 at one end of the receiving channel 165 through which the belt 110 may be inserted during installation of the security device 100 onto an article. The receiving channel 165 may also, according to some example embodiments, include a belt adjustment opening 166 at another end of the receiving channel 165, opposite the belt entry opening 164. The belt adjustment opening 166 may permit the adjustment end 112 of the belt 110 to extend out of the receiving channel 165 in situations where application of the security device 100 on a smaller article requires that the belt 110 be tightened to a point where the adjustment end 112 of the belt extends out of the receiving channel 165. In this regard, when the adjustment end 112 of the belt 110 extends beyond the belt adjustment opening 166 of the receiving channel 165, the adjustment end 112 of the belt 110 may be subsequently received into the receiving sleeve 125 (FIG. 2). In this regard, the adjustment end 112 of the belt 110 may be configured to pass through the receiving channel 165 and into a receiving sleeve 125. The receiving sleeve 125 may be affixed to the belt 110 and disposed adjacent the secured end 111 of the belt 110.

The housing 155 may also include a hub cavity 186 within which the hub 180 may be disposed. The shape and size of the hub cavity 186 may permit the hub 180 to rotate within the hub cavity 186. The hub 180 may be configured to rotate in line with the length of the receiving channel 165. The housing 155 may have side hub openings 188 in the hub cavity 186 that permit a lever engaging portion 191 of the hub 180 to extend out of the side hub openings 188 and beyond the side walls of the housing 155 to engage with the cavities 176 of the lever 175. The side hub openings 188 may be sized such that the hub 180 is maintained within the housing 155 due to an internal portion 198 (FIG. 9) of the hub 180 being larger than the side hub openings 188. The hub cavity 186 and the receiving channel 165 may also include a window 167 (or opening) between the hub cavity 186 and the receiving channel 165 to permit the hub 180 to operatively couple or engage the belt 110 via the window 167 depending on the position of the lever 175 and the hub 180.

In this regard, the shape of the hub 180, as shown in FIGS. 9 and 10, may also be designed to facilitate rotation within the hub cavity 186. The hub 180 may be, according to some example embodiments, a single molded component, but may be comprised of various features that perform various operational functions. A length of the hub 180 may extend along the axis 158. In this regard, the hub 180 may be comprised of an internal portion 198, rotation rings 194, and lever engaging portions 191. The lever engaging portions 191 may be disposed at the ends of the hub 180 and, as described above, may extend beyond the side walls of the housing 155 when the hub 180 is disposed in the housing 155. The lever engaging portions 191 may engage with, and be complementary to, the cavities 176 of the lever 175. In this regard, the lever engaging portions 191 may be protrusions that fit within the cavities 176. The lever engaging portions 191 may be keyed in a complementary fashion so that the lever 175 and the hub 180 may be only be assembled in a single relative orientation. In this regard, according to some example embodiments, the lever engaging portions 191 may be square in shape with one corner of the square being keyed by key edge 192. Via the lever engaging portions 191 of the hub 180, the lever 175 may be pivotably coupled to the housing 155 via the hub 180 to pivot relative to the housing 155 between a locked lever position and an unlocked lever position. Accordingly, the lever 175 may be coupled to the hub 180 such that the hub 180 rotates as the lever 175 pivots, where the lever 175 pivots and the hub 180 rotates about the common axis 158.

The rotation rings 194 of the hub 180 may be disposed internally adjacent to the lever engaging portions 191. The rotation rings 194 may be circular to facilitate rotation of the hub 180 relative to the housing 155. In this regard, the rotation rings 194 may be disposed within a rim of the side hub openings 188 of the housing 155 when the security device 100 is assembled. In this regard, the radius of the rotation rings 194 may be slightly less than that radius of the side hub openings 188 to facilitate a rotational sliding engagement between the rotation rings 194 and the rim of the side hub openings 188.

The internal portion 198 may disposed internally adjacent to the rotation rings 194. According to some example embodiments, the internal portion 198 of the hub 180 may be located central to the length of the hub 180. The internal portion 198 may be disposed, according to some example embodiments, entirely internal to the housing 155 and the internal walls of the housing 155 and the hub cavity 186. The internal portion 198 may be wider than the rotating rings 194 and the side hub openings 188, which may operate to maintain the hub 198 within the housing 155 when assembled.

The internal portion 198 of the hub 180 may include a belt engaging surface 199 and a belt non-engaging surface 195. According to some example embodiments, the belt engaging surface 199 and belt non-engaging surface 195 may define a circumference of the internal portion 198 of the hub 180, which may be cylinder shaped. The belt engaging surface 199 may be disposed along a portion of the circumference of the internal portion 198 that is defined by a belt engaging surface angle 196 having a vertex at the axis 158, which is also the center of rotation of the hub 180. Similarly, the belt non-engaging surface 195 may be disposed along a portion of the circumference of the internal portion 198 that is defined by a belt non-engaging surface angle 197 having a vertex at the axis 158. According to some example embodiments, the belt engaging surface angle 195 may be less than the belt non-engaging surface angle 197. According to some example embodiments, the belt engaging surface 199 may be include one or more belt engaging members, for example, in the form of teeth 193. The pitch or radial distance between the teeth 193 may be substantially the same or the same as the pitch or linear distance between the grooves 115 on the adjustment end 112 of the belt 110. As shown best in FIG. 10, the belt engaging surface 199 may, according to some example embodiments, include four teeth 193*a*, 193*b*, 193*c*, and 193*d*. Further, the belt non-engaging surface 195 may have an absence of belt engaging members. According to some example embodiments, the belt non-engaging surface 195 may be a smooth surface that is recessed relative to at least the extents of the engaging members of the belt engaging surface 199. In other words, the engaging members of the belt engaging surface 199 may protrude away from a center of the hub 180 (i.e., axis 158), and the engaging members may extend further away from the center of the hub 180 than any feature of the belt non-engaging surface 195.

Having described various example embodiments of the structure of an example security device 100, some operations of the security device 100 will now be described with respect to FIGS. 11 to 14. The operations described with respect to FIGS. 11 to 14 show the security device 100 transitioning from an unlocked configuration to a locked configuration and back to an unlocked configuration. FIGS. 11 to 14 show a side cross section view of the security device 100 so that the internal mechanisms can be viewed in the different configurations.

Accordingly, FIG. 11 shows the example security device 100 in an unlocked configuration where the security device 100 could be ready to be secured to an article. As can be seen, the lever 175 has been previously pivoted, about the axis 158, into an unlocked lever position. Because the hub 180 rotates with the lever 175, as the lever 175 pivots, the hub 180 is moved into an unlocked hub position. When the hub 180 is in the unlocked hub position, the hub 180 is not engaged with the belt 110. More specifically, when the hub 180 is in the unlocked hub position, the belt non-engaging surface 195 is in the receiving channel window 167 and therefore, the hub 180 is not engaged with the belt 110 because the non-engaging surface 195 does not extend through the window 167 to engage the adjustment end 112 of the belt 110. As such, the adjustment end 112 of the belt 110 is free to be slidably inserted or removed from the receiving channel 165.

To apply the security device 100 to an article, the belt 110 may wrapped around the article and the adjustment end 112 of the belt 110 may be inserted into receiving channel 165 and hand tightened. At this point, the user may begin to pivot the lever 175 downward and counter-clockwise in accordance with the arrow 210, towards the lever locked position. As the lever 175 is pivoted, the hub 180 also rotates in a counter-clockwise direction and the belt engaging surface 199 will turn towards the window 167. According to some example embodiments, the teeth of the belt engaging surface 199 may begin to engage the grooves 113 of the belt 110. The belt engaging surface 199 of the hub 180 may extend into the belt receiving channel 165 and operably couple with the belt 110 in response to the lever 175 being pivoted into the locked lever position and the adjustment end 112 of the belt 110 being inserted into the receiving channel 165. As the lever 175 continues to be pivoted downward and counter-clockwise, a rack and pinion type operation occurs where the rotation of the hub 180 and the teeth 193, when engaged with the grooves 113, cause the belt 110 to move further through receiving channel 165 in accordance with arrow 211 thereby further tightening the belt 110 onto the article. As such, as the lever 175 pivots from the unlocked lever position to the locked lever position, the hub 180 rotates such that the belt engaging surface 199 of the hub 180 transitions from not being operably coupled to the belt 110 to being operably coupled to the belt 110 and further applying a tightening force onto the belt 110.

Now referring to FIG. 12, the lever 175 has been pivoted into the lever locked position where the locking assembly and the security device 100 is in a locked configuration and the hub 180 is engaged with the belt 110. In this regard, as the lever 175 is moved into the lever locked position, the slug 178 may be urged by the spring 179 into the locking cavity 169 of the housing 155 to lock the lever 175 to the housing 155, and to maintain the hub 180 in a hub locked position as shown in FIG. 12. With the hub 180 being locked in position, the belt 110 cannot be removed from the receiving channel 165 due to the engagement between the belt 110 and the belt engaging surface 199 of the hub 180. Further, with the lever 175 in the lever locked position, a portion of the housing 155 may be received into the lever cavity 177.

Referring now to FIG. 13, a system is provided that includes the security device 100 and a key 200. The key 200 may be applied to the security device 100 to unlock and detach the security device 100 from an article. The key 200 may include a magnet 201. Because the slug 179 may be formed of a ferrous material that is attracted to magnetic fields, the presence of the key 200 and the magnet 201 in a position adjacent the slug 178 may cause the slug 179 to moved out of the locking cavity 169 against the urging of the spring 179. With the slug 179 removed from the locking cavity 169, the locking assembly is in the unlocked configuration, and the lever 175 is free to be pivoted into the unlocked lever position.

In FIG. 14, the lever 175 is pivoted back to the unlocked lever position via movement upwards and in a clockwise direction in accordance with the arrow 212. The pivoting of the lever 175 in the clockwise direction also causes the hub 180 to rotate in the clockwise direction. Because the belt engaging surface 199 of the hub 180 is still engaged with the belt 110, rotation of the hub 180 causes the belt to move out of receiving channel 165 towards the belt entry opening 164 of the receiving channel 165. The belt 110 will continue to move in this manner until the belt engaging surface 199 of the hub 180 is no longer engaged with the belt 110 and the belt non-engaging surface 195 is presented in the window 167. When the belt non-engaging surface 195 is presented in the window 167, the hub 180 is no longer engaged with the belt 110. As such, the hub 180 is in the unlocked hub position and the belt 110 is free to be slid out of the receiving channel 165 completely and removed from the article. Therefore, the belt non-engaging surface 195 of the hub 180 may be presented to the receiving channel 165 such that the hub 180 does not operably couple to the belt 110 in response to the lever 175 being in the unlocked lever position.

Many modifications and other embodiments set forth herein will come to mind to one skilled in the art to which these example embodiments pertain having the benefit of the teachings presented in the foregoing descriptions and the associated drawings. Therefore, it is to be understood that embodiments are not to be limited to those specific embodiments disclosed herein and that modifications and other embodiments are intended to be included within the scope. Moreover, although the foregoing descriptions and the associated drawings describe example embodiments in the context of certain combinations of elements and/or functions, it should be appreciated that different combinations of elements and/or functions may be provided by alternative embodiments without departing from the scope. In this regard, for example, different combinations of elements and/or functions than those explicitly described above are also contemplated. In cases where advantages, benefits or solutions to problems are described herein, it should be appreciated that such advantages, benefits and/or solutions may be applicable to some example embodiments, but not necessarily all example embodiments. Thus, any advantages, benefits or solutions described herein should not be thought of as being critical, required or essential to all embodiments. Although specific terms are employed herein, they are used in a generic and descriptive sense only and not for purposes of limitation.

What is claimed is:

1. A security device comprising:

a housing having a belt receiving channel;

a belt attached to the housing at a secured end of the belt, the belt being insertable into the receiving channel at an adjustment end of the belt, wherein the belt is configured to be wrapped around an article;

a lever pivotably coupled to the housing, the lever being configured to pivot relative to the housing between a locked lever position and an unlocked lever position; and a hub disposed within the housing and coupled to the lever such that the hub rotates as the lever pivots;

wherein the hub includes a belt engaging surface and a belt non-engaging surface;

wherein the belt engaging surface of the hub is configured to extend into the belt receiving channel and operably couple with the belt in response to the lever being pivoted into the locked lever position and the adjustment end of the belt being inserted into the receiving channel, and wherein the belt non-engaging surface of the hub is presented to the receiving channel such that the hub does not operably couple to the belt in response to the lever being in the unlocked lever position.

2. The security device of claim 1, wherein the belt engaging surface includes at least one tooth that is configured to engage one of a plurality of grooves in the belt.

3. The security device of claim 1, wherein the belt engaging surface and belt non-engaging surface define a circumference of a cylindrical portion of the hub.

4. The security device of claim 3, wherein the belt engaging surface defines a belt engaging surface angle relative to a center of rotation of the hub and the belt non-engaging surface defines belt non-engaging surface angle relative to the center of rotation of the hub; and wherein the belt engaging surface angle is less than the belt non-engaging surface angle.

5. The security device of claim 1, wherein the receiving channel includes a receiving channel window through which the engaging surface of the hub operatively couples to the belt.

6. The security device of claim 1, wherein the hub rotates and the lever pivots about a common axis.

7. The security device of claim 1, wherein as the lever pivots from the unlocked lever position to the locked lever position, the hub rotates such that the belt engaging surface of the hub transitions from not being operably coupled to the belt to being operably coupled to the belt and further applying a tightening force onto the belt.

8. The security device of claim 1 further comprising a locking assembly; and wherein the locking assembly is configured to lock the lever to the housing thereby preventing pivoting of the lever in response to the lever being pivoted into the locked lever position.

9. The security device of claim 8 wherein the locking assembly is configured to unlock the lever from the housing to permit pivoting of the lever in response to application of a magnetic key to the locking assembly.

10. The security device of claim 1 further comprising a locking assembly; and wherein the locking assembly is configured to lock the hub into a locked hub position in response to lever being pivoted into the locked lever position.

11. The security device of claim 1, wherein the adjustment end of the belt is configured to pass through the receiving channel and into a receiving sleeve, wherein the receiving sleeve is affixed to the belt and is disposed adjacent the secured end of the belt.

12. The security device of claim 1, wherein an electronic article surveillance tag is disposed in the housing.

13. The security device of claim 1, wherein at least a portion of the belt is transparent.

14. The security device of claim 1, wherein the lever includes a lever cavity; and wherein a portion of the housing is received into the lever cavity when the lever is in the locked lever position.

15. The security device of claim 1 wherein the receiving channel passes through the housing.

16. A system comprising:

a security device; and a magnetic key;

wherein the security device comprises:

a housing having a belt receiving channel;

a belt attached to the housing at a secured end of the belt, the belt being insertable into the receiving channel at an adjustment end of the belt, wherein the belt is configured to be wrapped around an article;

a lever pivotably coupled to the housing, the lever configured to pivot relative to the housing between a locked lever position and an unlocked lever position;

a hub disposed within the housing and coupled to the lever such that the hub rotates as the lever pivots; and a locking assembly;

wherein the hub includes a belt engaging surface and a belt non-engaging surface;

wherein the belt engaging surface of the hub is configured to extend into the belt receiving channel and operably couple with the belt in response to the lever being pivoted into the locked lever position and the adjustment end of the belt being inserted into the receiving channel, and wherein the belt non-engaging surface of the hub is presented to the receiving channel such that the hub does not operably couple to the belt in response to the lever being in the unlocked lever position;

wherein the locking assembly is configured to lock the lever to the housing thereby preventing pivoting of the lever in response to the lever being in the locked lever position;

wherein the locking assembly is configured to unlock the lever from the housing to permit pivoting of the lever in response to application of the magnetic key to the locking assembly.

17. A security device comprising:

a housing having a belt receiving channel;

a belt attached to the housing at a secured end of the belt, the belt being insertable into the receiving channel at an adjustment end of the belt, wherein the belt is configured to be wrapped around an article; and a hub disposed within the housing, the hub rotatable between a locked hub position and a unlocked hub position;

wherein the hub includes a belt engaging surface and a belt non-engaging surface;

wherein the belt engaging surface of the hub is configured to extend into the belt receiving channel and operably couple with the belt in response to the hub being in the locked hub position and the adjustment end of the belt being inserted into the receiving channel, and wherein the belt non-engaging surface of the hub is presented to the receiving channel such that the hub does not operably couple to the belt in response to the hub being in the unlocked hub position.

18. The security device of claim 17, wherein the belt engaging surface includes at least one tooth that is configured to engage one of a plurality of grooves in the belt.

19. The security device of claim 17, wherein the belt engaging surface and belt non-engaging surface define a circumference of a cylindrical portion of the hub.

20. The security device of claim 19, wherein the belt engaging surface defines a belt engaging surface angle relative to a center of rotation of the hub and the belt non-engaging surface defines belt non-engaging surface angle relative to the center of rotation of the hub; and wherein the belt engaging surface angle is less than the belt non-engaging surface angle.

* * * * *